US005865894A

United States Patent [19]

Reynolds

[11] Patent Number: 5,865,894

[45] Date of Patent: Feb. 2, 1999

[54] MEGASONIC PLATING SYSTEM

[75] Inventor: H. Vincent Reynolds, Marcellus, N.Y.

[73] Assignee: Reynolds Tech Fabricators, inc., Syracuse, N.Y.

[21] Appl. No.: 873,154

[22] Filed: Jun. 11, 1997

[51] Int. Cl.[6] ..... B05C 3/00

[52] U.S. Cl. ..... 118/429; 118/603

[58] Field of Search ..... 204/222, 224 R, 204/275, 297 R, 297 W, 212; 118/429, 416, 603, 602, 52; 427/443.1, 437, 346, 347; 134/902

[56] References Cited

U.S. PATENT DOCUMENTS

| | | | |
|---|---|---|---|
| 3,977,926 | 8/1976 | Johnson et al. | 118/416 |
| 4,118,649 | 10/1978 | Shwartzman et al. | 310/337 |
| 4,980,300 | 12/1990 | Miyashita et al. . | |
| 5,077,099 | 12/1991 | Kukanskis et al. | 427/437 |
| 5,365,960 | 11/1994 | Bran | 134/184 |
| 5,393,347 | 2/1995 | Miranda | 134/902 |
| 5,520,205 | 5/1996 | Guldi et al. | 134/98.1 |
| 5,578,193 | 11/1996 | Aoki et al. | 134/902 |

FOREIGN PATENT DOCUMENTS

| | | | |
|---|---|---|---|
| 0047935 | 2/1988 | Japan | 134/902 |
| 404099025 | 3/1992 | Japan | 134/902 |

*Primary Examiner*—Brenda A. Lamb
*Attorney, Agent, or Firm*—Trapani & Molldrem

[57] ABSTRACT

A plating cell adapted for electro-less plating of articles, for example, semiconductor wafers contained in a carrier or "boat", incorporates a megasonic transducer in the plating cell and a rotational drive supporting the wafer carrier in the plating cell. The megasonic transducer applies acoustic energy at megasonic frequencies to the solution in the cell during a plating operation, and the carrier is rotated at a suitable speed, e.g., 45 to 60 r.p.m. A rapid drain is provided to remove the solution from the cell quickly at the end of a plating operation, and a pair of spray tubes with a series of spray nozzles rinses the wafers with de-ionized water. Spargers at the base of the cell inject the plating solution, which proceeds generally upwards in a laminar flow, and spills over a spillway at the top of the plating tank. The spillway comprises a series of triangular teeth which avoid waves or turbulence.

18 Claims, 4 Drawing Sheets

MEGASONIC PLATING SYSTEM

BACKGROUND OF THE INVENTION

This invention relates to wet-process plating cells and equipment, and is more particularly directed to an improved plating cell for electroless plating in which megasonic energy is applied to the solution in the plating cell, and in which the workpieces or substrates are rotated during the plating process to achieve a uniform deposition of the plated material.

In a typical electroless process, e.g., for copper plating a silicon wafer, the plating solution is circulated through the plating cell and a number of silicon wafers are held in place in a carrier or boat in the plating cell. The boat is grooved internally to hold the wafers by their edges with a space between them. During the process, the boat and wafers are held still, and the solution circulates around them. Fresh solution is introduced into the plating cell through a sparger, and excess solution spills over the top wall into a catch. The solution is then piped back to a fluid conditioning tank, where the solution is filtered and its temperature is adjusted. Fresh chemicals are added, according to the dictates of the process chemistry. Then the solution is returned to the sparger. Irregularities and inhomogeneities are inevitable in the flow path of the fluid past the workpieces. These can lead to high or low spots in the copper plating. However, for precision high-density semiconductor work, extreme flatness is needed in each plating layer, including any copper or other metallic layers.

Megasonics have been employed in connection with semiconductor wafer processing, but only in connection with cleaning of the wafers prior to plating or etching. Several megasonic devices have been proposed for this purpose, and some of these have been made the subject of U.S. patents.

Shwartzman et al. U.S. Pat. No. 4,118,649 relates to a transducer assembly for producing acoustic energy at megasonic frequencies, i.e., from about 0.2 MHz to about 5 MHz, and applying the megasonic energy to a cleaning tank. Guldi et al. U.S. Pat. No. 5,520,205 and Bran U.S. Pat. No. 5,365,960 each relate to a megasonic leaning assembly for cleaning semiconductor wafers in a cleaning tank. The wafers are held on a carrier or boat in the cleaning tank. In each case, the megasonic energy is used to loosen material from the surface of the wafers, and it apparently did not occur to any of the inventors involved with the above-mentioned patents to apply megasonic energy for the opposite purpose, namely, to assist in depositing material on the surface of the wafers.

In addition, in each instance of megasonic cleaning, the carrier or boat is held static in the cleaning tank during a megasonic cleaning operation.

In a metal plating technique, flow regime for the plating solution within the tank or cell is crucial for successful operation. Flow regime is affected by such factors as tank design, fluid movement within the process vessel, distribution of fluid within the vessel and at the zone of introduction of the solution into the vessel, and the uniformity of flow of the fluid as it is contacts and flows across the wafer or other substrate. However, optimal sparger design can only achieve a limited increase in flatness of metallization, because of other factors affecting the flow, especially within the confines of the boat or carrier.

OBJECTS AND SUMMARY OF THE INVENTION

It is an object of the this invention to improve the flow regime of a plating cell, and in particular to permit the plating process to achieve coatings of high uniformity across the surface of a substrate.

It is a further object to improve a plating process by applying megasonic energy to the plating solution in the cell during a plating operation.

It is another object to improve the plating process by rotating the carrier and substrates within it during the plating process.

In accordance with an aspect of the present invention, an electro-less plating cell is provided for plating one or more substrates, e.g., silicon wafers, with a metal layer. A sparger or equivalent injection means introduces the electroless plating solution into the plating cell, in which the substrate to be plated is submerged in the solution. The sparger initiates a laminar flow of the plating solution, which flows across the surface of the substrate to be plated, and then rises up and spills over a spillway into a catch basin or the like. From here, the solution is returned for refreshing, filtration, and temperature management. A megasonic transducer adjacent the floor of the plating cell applies megasonic energy at a frequency of about 0.2 to 5 MHz to the solution. The frequency can be above 1 MHz, and in some cases above 5 MHz.

The flow regime is further improved by rotating the silicon wafers. This is achieved by placing the carrier or boat on a rotary mount that rotates, e.g. at 45–50 RPM. This arrangement avoids regions of dead flow within the carrier, and results in uniformity of the metallization thickness and quality.

The plating arrangement can also include a rapid drain feature for removing the solution within a few seconds from the plating cell at the end of a plating operation. This can comprise a large drain tube, e.g., one-and-one-half inch diameter, opening to the bottom of the plating cell. In addition, an overhead rinse arrangement is also provided, comprising a pair of parallel tubes with sprinkler nozzles or heads disposed along their length. These features combine to terminate the plating operation rapidly when the plating operation has reached completion.

The plating arrangement for wet plating a substrate, comprises a plating cell that contains a solution in which the substrate is immersed; sparger means in the plating cell adapted to introduce the solution into the cell; spillover means on the cell that permits the solution to spill over from the cell into a fluid return that is adapted to carry away the solution from the cell; carrier means for holding the substrate in the cell below the spillover means; fluid conditioning means coupled between the return and the sparger means to remove any particulate matter from the solution, condition the solution, and return the solution through a conduit to said sparger means; rotary means disposed in said bath and holding the carrier to rotate said carrier about an axis thereof; and megasonic transducer means in communication with the plating cell for applying to the solution in the cell acoustic energy at a megasonic frequency. In a preferred embodiment, an electroless plating system serves as the plating solution, and the fluid conditioning means includes make up means for adding electroless plating ingredients to the plating system to keep the plating solution properly in balance. Preferably the spillover means on the plating cell includes a succession of triangular teeth disposed along an upper edge of said plating cell. The triangular teeth may continue along the entire periphery of said upper edge of the plating cell.

The wafer carrier boat has a series of grooves for holding a plurality of substrate disks spaced from one another. A hinged lid closes over the top to retain the substrate disks in the carrier boat even when inverted. The carrier boat can be rotated continuously or can be rocked back and forth over a rotational arc of less than 360 degrees.

The above and many other objects, features, and advantages of the invention will become apparent from the ensuing description of a preferred embodiment thereof, which should be read in conjunction with the accompanying Drawing.

DETAILED DESCRIPTION OF THE PREFERRED EMBODIMENT

Figure 1A:
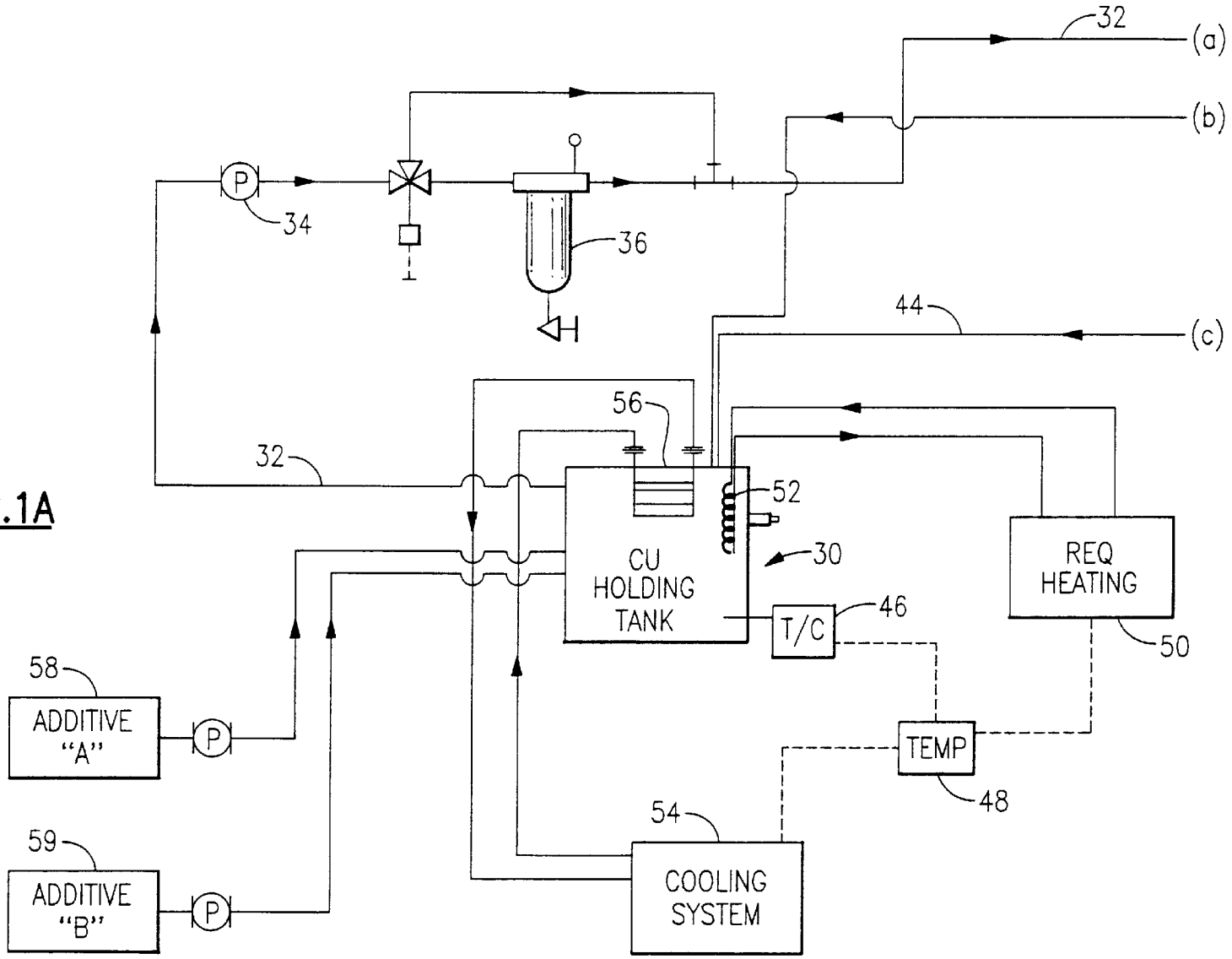
FIG. 1, formed of FIGS. 1A and 1B, is a schematic diagram of a plating cell and reservoir assembly according to one embodiment of the present invention.
Figures 1, 1B:
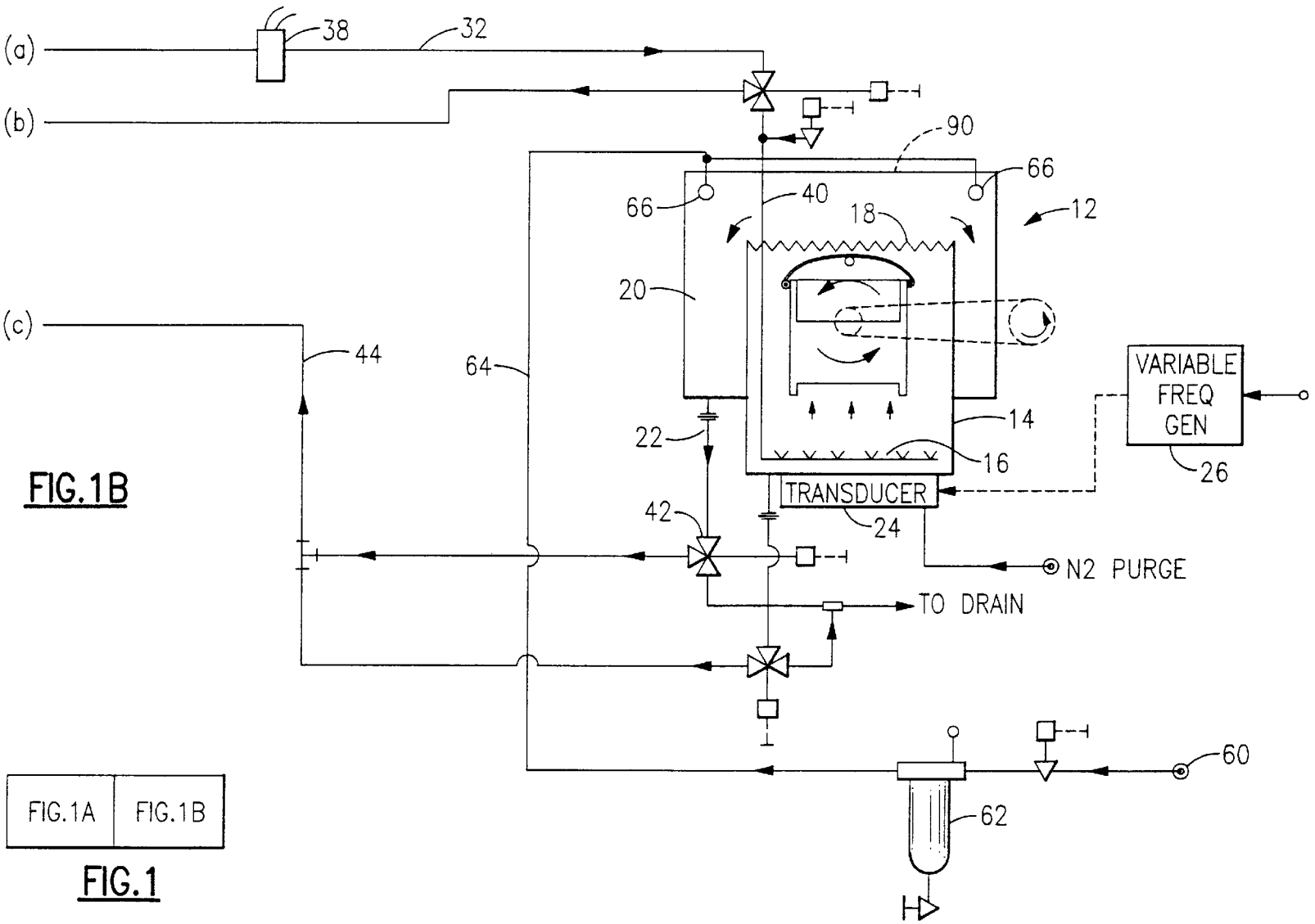
Figure 2:
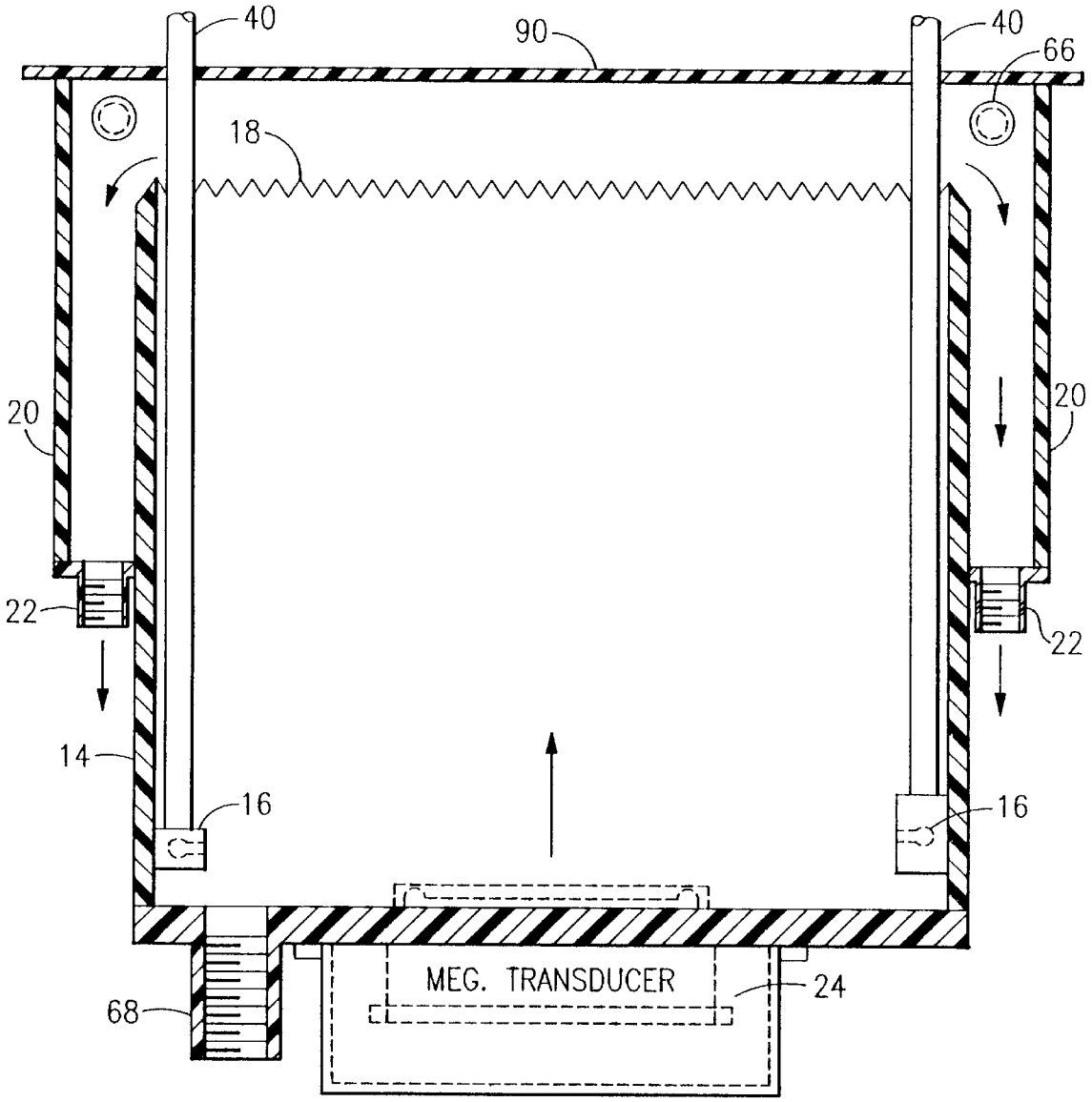
FIGS. 2 and 3 are a front elevation and a perspective view, respectively, of the plating cell illustrating the megasonic transducer and rotation feature, according to this embodiment of the invention.
Figure 3:
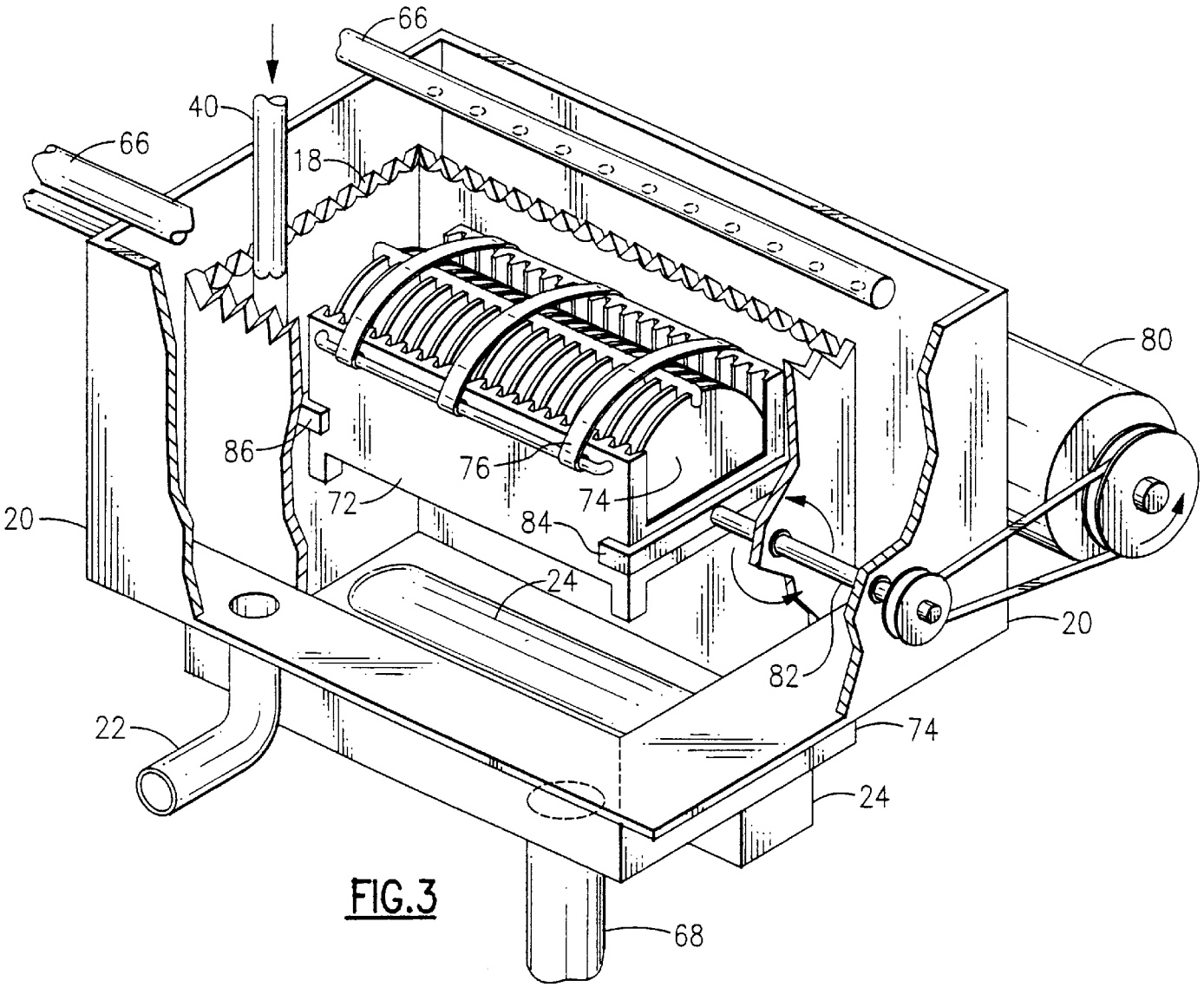

With reference to FIGS. 1 to 3 of the Drawing, an electroless plating assembly 10 for metallizing silicon wafers or similar articles is shown to comprise a plating cell 12, formed of a suitable chemically neutral material, e.g. polypropylene. The cell has a generally rectangular tank 14 with an open top and with a sparger or spargers 16 disposed at the bottom. The spargers generate a generally laminar, upward flow of liquid in the tank 14. The solution spills out over a spillway 18 formed at the top of the tank 14. The spillway comprises a row of triangular serrations or teeth which extend over the entire upper periphery of the tank. An annular catch or trough 20 surrounds the spillway 18 and tank 14, to receive the flow of solution escaping over the spillway. There is at least one drain tube 22 positioned on the catch 20.

A generally rectangular, elongated transducer 24 is situated in the base or bottom of the tank 14 at about the center and extending from a front end to a rear end. This transducer 24 is adapted for generating megasonic acoustic energy which is applied to the solution within the tank 14. A variable frequency generator 26 applies a variable frequency signal to the transducer 24 at a frequency in the megasonic range, that is, between about 200 KHz and about 5 MHz. The generator 26 can apply a steady signal at a single frequency, a signal that alternates between two frequencies, or a signal that sweeps across a broad band of frequencies, depending on the plating process. There is also a nitrogen purge supply for applying nitrogen gas to the transducer.

A reservoir or solution holding tank 30 holds a supply of the electro-less plating solution, and a supply line 32 leads from the tank 30. A pump 34 propels the solution through the line 32, through a particle trap 36 and a flow sensor 38, to a feed line 40 that supplies fresh solution to the spargers 16. At a three-way valve 42 connected to the drain 22, a return line 44 returns the solution from the plating cell 12 to the reservoir holding tank 30.

At the tank 30, a temperature sensor 46 senses the temperature of the solution and signals a temperature controller 48. The controller operates a heat supply 50 that sends heat at a controlled rate to a heat exchanger coil 52 within the holding tank 30. The controller also operates a cooling system 54, which supplies a coolant fluid to a cooling heat exchanger coil 56 within the tank 30. A first make-up injector means 58 and a second make-up injector means 59 blend in additive components A and B, respectively, into the solution in the tank 30, as needed. The solution in the tank 30 is thus kept at a controlled temperature and blend, and is filtered before being returned, through the spargers 16, into the tank 14.

A deionized water source 60 is coupled to a particulate trap 62 and then to a feed line 64 to supply de-ionized water to a pair of spray tubes 66. These spray tubes 66 are positioned above the top of the tank 14 and are in parallel with each other on either side of the axis of the tank 14. The spray tubes 66 are each provided with a row of spray nozzles or outlets along the length of the tubes 66.

As shown in FIG. 2, the spargers 16 each have a row of through holes parallel to one another and oriented generally towards the axis of the tank 14, so as to generate a generally laminar flow of the solution. Here, the spargers have a single row of holes but in practice there could be two or more parallel rows.

The cell 12, reservoir 30, and various pipes and lines are formed of polypropylene, or of another suitable corrosion-resistant material. The material should also be selected to be easy to clean after an electroless plating operation.

A rapid drain 68 is disposed at the bottom of the plating tank 14 for rapidly draining the solution from the tank at the end of a plating operation. This can be a pipe of relatively large diameter, here about one and one-half inches, so that all of the liquid in the tank can be drained away in a few seconds. The drain 68 connects to a three-way valve 70, leading alternatively to a common drain and to the return conduit 44.

Within the tank 14 is positioned a carrier 72 or "boat" for holding a series of workpieces, which in this embodiment are semiconductor wafers 74 in the form of disks. The carrier is open at its top, and has a series of grooves such that the wafers can be positioned in spaced relation and held in place by their edges. The carrier 72 is open over much of its body, to permit substantially free flow of liquids past the wafers 74. A closure 76 is provided, hinged at one side of the carrier 72, to hold the wafers 74 in place when the carrier is inverted. The closure 76 has a central grooved bar that fits the edges of the wafers.

Rotary means 80 are fitted onto the cell 12, here shown as a rotary drive with a belt connected to a shaft 82 that passes through sealed bearings in the walls of the cell 14 and catch 20. There is a front claw or gripper 84 on the shaft 82, and this gripper grips and holds the carrier or boat 72 at its front end. A rear claw or gripper, pivotally journalled in the rear wall of the cell 12, similarly grips the rear end of the carrier 72. The specific configuration of the claws 84, 86 and the rotary drive 80 is not critical to this invention, and these means can be adapted to the specific application and to match the associated carrier. Alternatively, the rotary means 80 can be fluid powered using the solution flow to the spargers.

The rotary means 80 is here adapted for continuous rotary operation, i.e., to rotate the carrier 72 and its wafers 84 at about 45 to 60 r.p.m. However, the rotary means could be adapted to a different rotation speed, as necessary to the particular plating operation. As an alternative, the rotary means could be adapted to rotate partially, or rock the carrier 72 through a limited arc, e.g., 90 degrees to 120 degrees.

The plating arrangement as shown here can be used for electroless plating of copper onto silicon wafers, but the arrangement is not limited to that. This invention can be employed for depositing other metals, or even composites or non-metals, onto substrates of silicon or other materials.

The operation of this plating arrangement 10 can be described briefly as follows. The disks or wafers 74 are arranged in the respective slots in the carrier or boat 82, and are subjected to any necessary preparatory steps, e.g., a cleaning operation. The latter may also employ megasonics, as in the above-identified patents. Then the carrier 72 is placed in the tank 14 and is secured between the front and rear claws 84 and 86. A lid or cover 90 (FIG. 2) is then secured over the top of the process cell 12. The electroless plating solution is supplied from the reservoir 30 to the spargers 16 and is introduced into the tank 14, which fills to the level of the saw-tooth spillway 18. The solution is supplied continuously, so that there is a continuous upward flow of the solution through and past the wafers 74. The process continues for a prescribed length of time. During this time, the frequency generator 26 supplies a megasonic signal to the transducer 24, which creates megasonic waves in the solution in the tank. The rotary means 80 rotates the carrier 72 about its linear axis at a suitable speed, e.g. 45 r.p.m. These effects combine to create a plated copper layer of uniform thickness and quality on each of the wafers 74.

At the end of the plating period, the megasonic transducer is turned off, and the supply line is turned off to stop the supply of fresh solution to the spargers 16. Valve 70 is opened to drain away the solution through the rapid drain 68. At this time, the valve sends the solution to the reservoir 30 via the line 44. The contents of the tank 14 are drained out in a few seconds. Then the de-ionized water supply is turned on, and the tubes 66 spray clean, de-ionized water onto the wafers 74. This action rinses any residual plating solution from the wafers. The rinse water then proceeds out the drain 68 to the valve 70 which is now switched to the common drain.

Then the boat or carrier 74 is removed, and the wafers subjected to the next process step.

It should be appreciated that the reservoir 30 and associated process management equipment can be employed in common with a numnber of plating cells. In addition, the plating cell 12 can be connected to a number of plating reservoirs, each containing a different plating solution associated with different process steps.

While this invention has been described in detail with reference to a preferred embodiment, it should be recognized that the invention is not limited to that embodiment. Rather, many modifications and variations will become apparent to persons of skill in this art without departing from the scope and spirit of the invention, as defined in the appended claims.

What is claimed is:

1. A plating arrangement for wet plating a substrate, comprising a plating cell that contains a plating solution in which said substrate is immersed for electrodes plating of said substrate with a metal layer; sparger means the said plating cell adapted to introduce the solution into said plating cell; spillover means on said plating cell that permits the solution to spill over from said plating cell into a fluid return that is adapted to carry away the solution from said plating cell; carrier means for holding said substrate in the cell below the spillover means; fluid conditioning means coupled between the return and the sparger means to remove any particulate matter from said solution, condition the solution, and return the solution through a conduit to said sparger means; rotary means disposed in said plating cell and holding said carrier means to rotate the same about an axis thereof; and megasonic transducer means in communication with said plating cell for applying to the solution in said cell acoustic energy at a megasonic frequency; wherein said fluid conditioning means includes make up means for adding electroless plating ingredients to said plating cell to keep the plating ingredients in the solution properly in balance.

2. The plating arrangement of claim 1 wherein said spillover means includes a succession of triangular teeth disposed along an upper edge of said plating cell.

3. The plating arrangement of claim 2 wherein said triangular teeth are disposed continuously along an entire periphery of said upper edge of said plating cell.

4. The plating arrangement of claim 1 wherein said rotary means includes means for continuously rotating said carrier means in said plating cell during a plating operation.

5. The plating arrangement of claim 1 wherein said megasonic transducer means includes an elongated transducer member disposed at a base of said plating cell and parallel to the axis of said carrier means.

6. The plating arrangement of claim 1 wherein said megasonic frequency is about 500 KHz or above.

7. The plating arrangement of claim 6 wherein said megasonic frequency is about 1 MHz or above.

8. The plating arrangement of claim 1 wherein said cell includes rapid drain means for draining the solution from said plating cell within a drain period of about ten seconds or less.

9. The plating arrangement of claim 8 wherein said rapid drain means includes a drain pipe having a diameter of at least about 1½ inches.

10. The plating arrangement of claim 1 further comprising rinse means disposed above said plating cell for spraying said substrates with a rinsing fluid.

11. The plating arrangement of claim 10 wherein said rinse means includes at least one spray mechanism disposed above said carrier in said plating cell, and means supplying said spray mechanism with said rinsing fluid.

12. The plating arrangement of claim 11 wherein said at least one spray mechanism includes a pair of spray tubes disposed over said carrier and on opposite sides of said axis, with each tube having a plurality of spray nozzles along its length.

13. The plating arrangement of claim 1 wherein said sparger means includes a pair of spargers disposed parallel to the axis of said carrier, and each having a plurality of injection openings disposed along its length.

14. A plating arrangement for wet plating a substrate, comprising a plating cell that contains a solution in which said substrate is immersed; sparger means in the cell adapted to introduce the solution into the cell; spillover means on the cell that permits the solution to spill over from the cell into a fluid return that is adapted to carry away the solution from the cell; carrier means for holding the substrate in the cell below the spillover means; fluid conditioning means coupled between the return and the sparser means to remove any particulate matter from the solution, condition the solution, and return the solution through a conduit to said sparser means; rotary means disposed in the cell and holding said carrier means to rotate the same about an axis thereof; and megasonic transducer means in communication with the cell for applying to the solution in the cell acoustic energy at a megasonic frequency; wherein said carrier means includes a wafer carrier boat having a series of grooves for holding a plurality of substrate disks separated from one another, and which has an open top; and means closing over said top to retain said substrate disks in said carrier boat when said carrier means is inverted.

15. A plating arrangement for wet plating a substrate, comprising a plating cell that contains a solution in which said substrate is immersed; sparser means in the plating cell adapted to introduce the solution into the plating cell; spillover means on the plating cell that permits the solution to spill over from the plating cell into a fluid return that is adapted to carry away the solution from the plating cell; carrier means for holding the substrate in the cell below the spillover means; fluid conditioning means coupled between the return and the sparger means to remove any particulate matter from the solution, condition the solution, and return the solution through a conduit to said sparger means: rotary means disposed in the plating cell and holding said carrier means to rotate the same about an axis thereof; and megasonic transducer means in communication with the plating cell for applying to the solution in the plating cell acoustic energy at a megasonic frequency; wherein said rotary means includes means for rocking said carrier means in the plating cell during a plating operation.

16. A plating arrangement for wet plating a substrate, comprising a plating cell that contains a plating solution in which said substrate is immersed for plating with a metal layer; sparger means in the cell adapted to introduce the solution into the cell; spillover means on the cell that permits the solution to spill over from the cell into a fluid return that is adapted to carry away the solution from the cell; carrier means for holding the substrate in the cell below the spillover means; fluid conditioning means coupled between the return and the sparger means to remove any particulate matter from the solution, condition the solution, and return the solution through a conduit to said sparger means; means disposed in said bath and holding said carrier in the cell; and megasonic transducer means in communication with the cell for applying to the solution in said cell acoustic energy at a megasonic frequency.

17. The plating arrangement of claim 16 wherein said megasonic frequency is about 500 KHz or above.

18. The plating arrangement of claim 17 wherein said megasonic frequency is about 1 MHz or above.

* * * * *

UNITED STATES PATENT AND TRADEMARK OFFICE

CERTIFICATE OF CORRECTION

PATENT NO. : 5,865,894

DATED : Feb. 2, 1999

INVENTOR(S) : H. Vincent Reynolds

It is certified that error appears in the above-identified patent and that said Letters Patent is hereby corrected as shown below:

Col 5, lines 53-55:

"; sparger means the said plating cell adapted to introduce the solution into said plating cell" changing to read-- ; sparger means in the Plating Cell adapted to introduce the solution into said Plating Cell--.

Col. 6, lines 53 and 56; col. 7, line 1:

"sparser" should read --sparger--

Signed and Sealed this

Sixth Day of July, 1999

*Attest:*

*Attesting Officer*

Q. TODD DICKINSON

*Acting Commissioner of Patents and Trademarks*